US005749164A

United States Patent [19]

Bowden

[11] Patent Number: 5,749,164

[45] Date of Patent: May 12, 1998

[54] WEB DRYER WITH COANDA AIR BARS

[75] Inventor: Edwin Vincent Bowden, Riddlesden, United Kingdom

[73] Assignee: Spooner Industries Limited, Ilkley, United Kingdom

[21] Appl. No.: 649,676

[22] PCT Filed: Nov. 18, 1994

[86] PCT No.: PCT/GB94/02549

§ 371 Date: Aug. 5, 1996

§ 102(e) Date: Aug. 5, 1996

[87] PCT Pub. No.: WO95/14199

PCT Pub. Date: May 26, 1995

[30] Foreign Application Priority Data

Nov. 19, 1993 [GB] United Kingdom ..... 9323954

[51] Int. Cl.[6] ..... E26B 9/00

[52] U.S. Cl. ..... 34/641; 34/643

[58] Field of Search ..... 34/641, 643, 640

[56] References Cited

U.S. PATENT DOCUMENTS 3,776,440 12/1973 Frost et al. .
3,982,328 9/1976 Gustafsson et al. .
4,591,517 5/1986 Whipple et al. .
4,698,914 10/1987 Shu et al. .
4,944,098 7/1990 Hella et al. .
5,105,562 4/1992 Hella et al. .
5,524,363 6/1996 Seidl et al. ..... 34/629

FOREIGN PATENT DOCUMENTS 0413519 2/1991 European Pat. Off. .

*Primary Examiner*—Henry A. Bennett
*Assistant Examiner*—Dimmatia Doster
*Attorney, Agent, or Firm*—Adams Law Firm, P.A.

[57] ABSTRACT

The invention relates to improvements in drying webs and is applicable with particular advantage, although not limited to, a process carried out in a paper making machine; that of the application of 'size' or 'coating'.

A web dryer (1) comprises two air bar assemblies (3,5) between which a web (7) travels, each air bar assembly (3,5) comprises a plurality of parallel and spaced apart air bars (9), each air bar (9) being elongate and arranged such that its longitudinal axis is transverse to the direction of travel (A) of the web (7), in which each of the air bar assemblies (3,5) includes at least two sets of air bar, a first set (13) comprises coanda air bars, and the second set (15) comprises jet impingement air bars.

9 Claims, 6 Drawing Sheets

WEB DRYER WITH COANDA AIR BARS

This application is a national stage application, according to Chapter II of the Patent Cooperation Treaty. This application claims the priority date of Nov. 19, 1993 for Great Britain Patent Application No. 9323954.9.

FIELD OF THE INVENTION

The invention described here relates to improvements in drying webs and is applicable with particular advantage although not limited to a process carried out in a paper making machine, that of the application of "size" or "coating".

Such coatings are normally aqueous based and need to be dried by evaporation of the aqueous content. One particular problem associated with the application of "on machine" size/coating is that unless it is sufficiently dried before contact with the drying cylinders a phenomenum known as "picking" takes place. "Picking" results in areas of size/coating building up on the after-drying cylinders causing cylinder contamination, and leading to product quality problems. Hence there is a requirement for a device that will adequately dry the size or coating once applied to the paper web which can be positioned within the area of the paper making machine under consideration. Furthermore the area in question is very often limited in terms of space and thus the required device must be extremely compact and of high intensity in terms of its evaporation potential.

In recent times the approach to this problem has been to position a non contact "air turn" device between the size/coating application and the first "after-drying" cylinder, thereby setting up the correct sheet geometry through the size press/coater and creating a long uninterrupted length of web path into which an infra red radiation heating unit could be positioned. The purpose of the infra red unit is to achieve the required evaporation of water from the coated paper web.

There are problems however which can be attributed to the application of infra red radiation devices, namely:

1 Fire risk.

2 Sheet instability caused by turbulence within the unit leading to contamination, poor quality and risk of sheet creasing.

3 Hostile environment surrounding the unit due to the very high radiation temperatures and consequent heat loss, with attendant inefficiencies.

4 Typically in gas fired infra-red systems, there is high thermal inertia i.e. slow response on both start-up and shut-down.

5 Poor mass transfer capability resulting from the predominance of radiation heat transfer with low air movement.

Thus, it is desirable to identify an improved method of web drying. Typically webs coated with 'wet' size or coating are handled by air flotation systems. Such systems allow a web to be supported in a cushion of gas, usually air, without contact, and therefore damage to the coated surface.

A typical air flotation system comprises two air bar assemblies, between which a web travels. Each air bar assembly includes a plurality of parallel and spaced apart air bars, each air bar being elongate and arranged such that its longitudinal axis is transverse to the direction of travel of the web. Each air bar has a web facing surface through which gas, typically air, flows from the air bar.

Although the gas used in air flotation systems is often air, at times different gases need to be used to support the web.

In the specification the term 'air bar' and 'air flotation system' will be used to encompass systems which could also operate with gases other than air.

In one form of air bar, each air bar includes an air inlet and on the web facing surface, a pair of parallel linear nozzles through which air passes to impinge on the web to support it. The nozzles are arranged such that they are aligned with the longitudinal axis of the air bar so that the nozzle lies transverse to the direction of travel. Many such air bars operate using the Coanda effect which causes the air flow to converge. This is arranged by providing a central top plate lying between the nozzles where each edge of the top plate forms one edge of a respective nozzle which is radiused such that air flowing from the nozzle flows over the radius and across towards the centre of the top plate. A typical air bar operating using these principles is described in UK patent specifications 1 302 091 and 1 302 092.

An alternative form of air bar also operates using the Coanda effect, and is known as an 'air foil'. Here the air bar is elongate but is asymmetric about its longitudinal axis. Each air foil includes one linear nozzle. The nozzle is arranged such that it is not along the centre of the air bar but is closer to the edge which the web first meets when travelling over the air bar. The nozzle is arranged to feed a jet of air in a diagonal direction towards the web, the air bar including a sloped plate which slopes in a direction away from the nozzle and towards the web and then to a top plate substantially parallel to the web. By the Coanda effect, the air fed out of the nozzle adheres to the sloping plate and then to the top plate to form an air cushion to support the travelling web.

The terms 'coanda effect' and 'coanda air bars' will be well known to the skilled addressee of the specification, and the term 'coanda air bar' will here be used to encompass any air bar from which air may flow exhibiting a coanda effect, as opposed to a jet impingement air bar from whose web facing surface air is blown to impinge upon the web, with no exhibition of coanda effect. The term 'jet impingement air bar' will be used to encompass any such air bar exhibiting no coanda effect. Such jet impingement air bars typically have a perforate upper surface with a series of spaced small orifices, but may equally include slots or nozzles through which the air flows.

To satisfy the evaporative requirement for drying within a small dimension in machine direction, it was necessary to develop an air impingement system which would support the web being processed in a stable manner as well as deliver extremely high heat transfer rates. Standard air flotation systems could not be configured to achieve this in the confined space available.

This is because a standard air flotation system's ability to evaporate is based on the temperature and velocity of the air it is discharging to the surface of the web. It will be clear to the skilled addressee of the specification that the use of extreme temperatures could cause problems in material selection and machine design (e.g. thermal expansion).

There are problems also when operating conventional air flotation nozzle systems at high air velocities of circa more than 70 m/second with accompanying low web tensions of circ 5 kg/m width. Under these high air velocity and low web tension conditions the nozzle to paper web distance in operation could be typically of the order of 40 mm and too high to maintain the positive web stability characteristics and maintain the heat transfer capability of a standard flotation system.

U.S. Pat. No. 3,982,328 (Aktiebolaget Svenska Flaktfabriken) discloses a web dryer comprising two air bar assemblies between which a web travels, each air bar assembly comprising a plurality of parallel and spaced apart air bars, each air bar being elongate and arranged such that its longitudinal axis is transverse to the longitudinal axis of the dryer, each of the air bar assemblies including at least two sets of air bar, a first set comprising coanda air bars, each having at least two air nozzles, and a second set comprising jet impingement air bars and in which the air bar assemblies are arranged such that in use each coanda air bar from one assembly faces a jet impingement air bar from the other assembly.

The present invention is characterised in that air flows flowing from each of the air nozzles of a coanda bar converge towards the centre of this bar.

Air exiting from the jet impingement air bars causes their velocity pressure to be transferred into static pressure on the web. The air flows flowing from each of the air nozzles of a coanda bar converge towards the centre of the bar and exert a cushion pressure on the other side of the web. The effect of these opposed pressure regions has the action of suppressing the amplitude of the sine wave generated by the coanda air bars and it maximises the heat transfer capability of the nozzle system and ensures web stability.

As already explained, the term "Coanda air bar" shall include any air bar which includes nozzles and upper surfaces arranged such that air passing through the nozzles exhibits the Coanda effect.

The term "jet impingement air bar" will be taken to include an air bar exhibiting no coanda effect, in which the upper surface is perforate and air is blown through the upper surface to impinge upon the web.

The preferred embodiment of the dryer includes each of the air bar assemblies being arranged with alternating coanda air bars and jet impingement air bars, such that between each pair of coanda air bars lies a jet impingement air bar, and between each pair of jet impingement air bars lies a coanda air bar.

In addressing the aforementioned problems this invention offers the following.

1 Capability of achieving a variable evaporation requirement up to the maximum demand conditions as dictated by the process requirements.

2 Ability to process a web by supporting it on air or other gas with complete stability.

3 Energy efficient operation.

4 Low thermal inertia facilitating rapid response.

5 Compatability with the paper machine, its operation and its surroundings.

6 Greatly reduced fire risk (compared to infra red).

The nozzle system comprising coanda nozzles opposed by jet impingement nozzles gives high heat transfer coefficient, complete web stability and non-contact operation.

The jet impingement air bar, in addition to contributing considerably to the heat transfer capability of the system, also has the direct influence of suppressing a high amplitude sine wave. Because of this the system is able to utilise high air velocities at low tensions and retain complete web stability and non-contact operation.

In this manner the invention guarantees the required high evaporation rates, complete web stability and non-contact operation, irrespective of web tension which hitherto was not possible.

The coanda air bar preferred is that sold by Spooner Industries Ltd of Moorland Engineering Works, Railway Road, Ilkley LS29 8JB under the trade mark SPOONER-FLOAT.

Preferably the jet impingement air bar includes a web facing surface which is perforate, preferably including a plurality of relatively small orifices.

Preferably each of the coanda, and jet impingement, air bars has mounted within it a diffuser plate to ensure even air flow.

In this system it is preferred that the air that is delivered to the nozzle system is delivered in a uniform manner with respect to the cross-machine and machine direction, in terms of both temperature and velocity of the impinging air. Preferably each air bar assembly includes at least one air feed duct capable of feeding air to the air bars, where each air bar is fed via a plurality of feed inlets spaced along the air bar, the air feed duct extending substantially along the length of the air bar and coupled to a source of pressurised air (or other gas) in the region of one end of the air bar, the air feed duct tapering along the length of the air bar, such that the cross-section of the duct is greater at the end of duct at the region of the gas source, and least at the end of the duct remote from the gas source.

This serves to ensure that gas of substantially constant pressure is fed to the air bar along its length in the cross machine direction.

The dryer preferably also includes flow regulators positioned in the air feed duct and in a gas return duct. Such flow regulators may comprise dampers, vanes, diffuser plates or valves.

The tapered duct feed and return systems with such flow regulator devices gives uniform cross-machine nozzle velocity and uniform movement of the "spent" return air.

To achieve the high evaporation rates demanded of the device it displays a very high heat transfer coefficient at elevated temperatures and impingement velocities. Typically the temperature will be in the region of 450° C. and the impingement velocity will be in the region of 70 m/s.

However, it should be noted that the apparatus can operate across a wide range of temperatures and velocities, from standard lower temperatures (as used in conventional air flotation systems) to temperatures well in excess of 450° C.

To achieve the envisaged elevated operating temperatures mentioned above the system would normally be heated by direct gas firing but the design is not limited to this method of heating and other fuel sources may well be employed (e.g. steam, oil, electricity, turbine exhaust etc).

Preferably the region of the air bars and the web will have its internal environment isolated from the surrounding environment by the use of a specially designed single slot nozzle (positioned either side of the web at entry and exit) acting as a dynamic seal curtain. Such nozzles are known in the art as 'anti-overspill' nozzles, and the choice of an appropriate nozzle will be apparent to the skilled addressee of the specification. Web positioning may be achieved at entry and exit by controlling the available cushion pressure to the coanda air bars and/or the jet impingement air bars at said positions.

Preferably at least one of the air bars positioned at each of the entry and exit ends of the assembly includes a flow regulator to control the flow of gas into that air bar. Typically such flow regulator comprises a manually operable damper. Preferably both air bars at each of the exit and entry ends of the assembly include such flow regulators to give maximum control. The antispill nozzles preferably include such dampers.

To minimise dryer volume requirements only the feed ducts/chambers/nozzles etc may be housed between the paper machine frames. The external equipment such as fans, combustion chamber etc typically will be sited away from the machine and a series of ducts will convey the necessary gas movement. However, it may be possible to site them within the dryer frame in some cases.

Preferably the dryer is capable of being positioned in a confined space. Although the space available is a variable from machine to machine, in general the area into which the invention is to fit is of the order of 2 meters in machine direction and 1 meter from the web to the top of the dryer shell (i.e. 2 meters in total). However, the invention is equally applicable to larger or smaller dryers.

In many air flotation systems, it is known to have one or both of the air bar assemblies mounted to move towards and away from the other air bar assembly. This allows web feeding, inspection, repair and changing of one or more of the air bars without needing to dismantle the entire machine. It is possible for the present web dryer to include air bar assemblies movable towards and away from each other.

In this case it is preferred that at least one of the air bar assemblies is pivotably mounted with respect to a pivot axis substantially parallel to the web, at or adjacent one end of the air bars, the air bar assembly being mounted within a shell of tapered construction with its dimension in a direction perpendicular to the plane of the web tapering from a maximum in the region of the pivot axis to a minimum in the region of the end of the assembly remote from the pivot axis.

Preferably both of the air bar assemblies are pivotably mounted, about respective parallel axes and are mounted within respective shells which taper in the same direction.

Preferably the pivot point is at the drive side of the machine with the narrowest part being the front or operator side of the machine.

When access to the dryer is required, the upper and lower halves are moved apart, by pneumatic cylinders or similar actuators. It is evident that the dryer housing will not occupy any more headroom when open than when closed, and in this way the available space is maximised.

The combination of the preferred features of the tapered shell construction with a tapered air feed duct is particularly advantageous. Here the tapered duct may fit within the tapered shell, such that the gas source is at the same end of the air bar assembly as the pivot axis.

The nozzle system and duct system being housed within a tapered shell construction permits good access to the internals of the dryer for purposes of cleaning etc as well as maximising the space available.

This invention allows the dryer to fit in a very confined space on a paper machine following the size press/coater and to render the paper dry enough for intimate contact with the after-drying cylinders and thus eliminate the possibility of "picking" which leads to product quality problems.

The dryer preferably operates with a high energy efficiency.

The completed unit must be compatible with the paper machine, its operation and its surroundings.

The unit preferably possesses low thermal inertia, thus facilitating rapid response to changes in process conditions.

The use of these higher than average air temperatures dictates the use of heat resistant materials as well as design and construction techniques that will accommodate the demands imposed by high temperature operation and rapid changes thereof (e.g. thermal expansion).

The invention also encompasses a paper machine including a web dryer in accordance with the first aspect of the invention.

The invention may advantageously comprise a method for ensuring compatibility with operation of the paper machine. On start up, a paper tail is threaded via "threading ropes" and "threading wheels" mounted on or adjacent to the invention and during operation the invention is controlled by an externally mounted control panel.

A further development of the dryer will be to integrate within the dryer housing infra-red emitters, in a manner such that the positive benefits of both the Infra-Red and the forced convection flotation dryer system are realised.

BRIEF DESCRIPTION OF THE DRAWINGS

A web dryer in accordance with the invention will now be described, by way of example only, with reference to the accompanying drawings, in which.

DESCRIPTION OF THE PREFERRED EMBODIMENT

Figure 1:
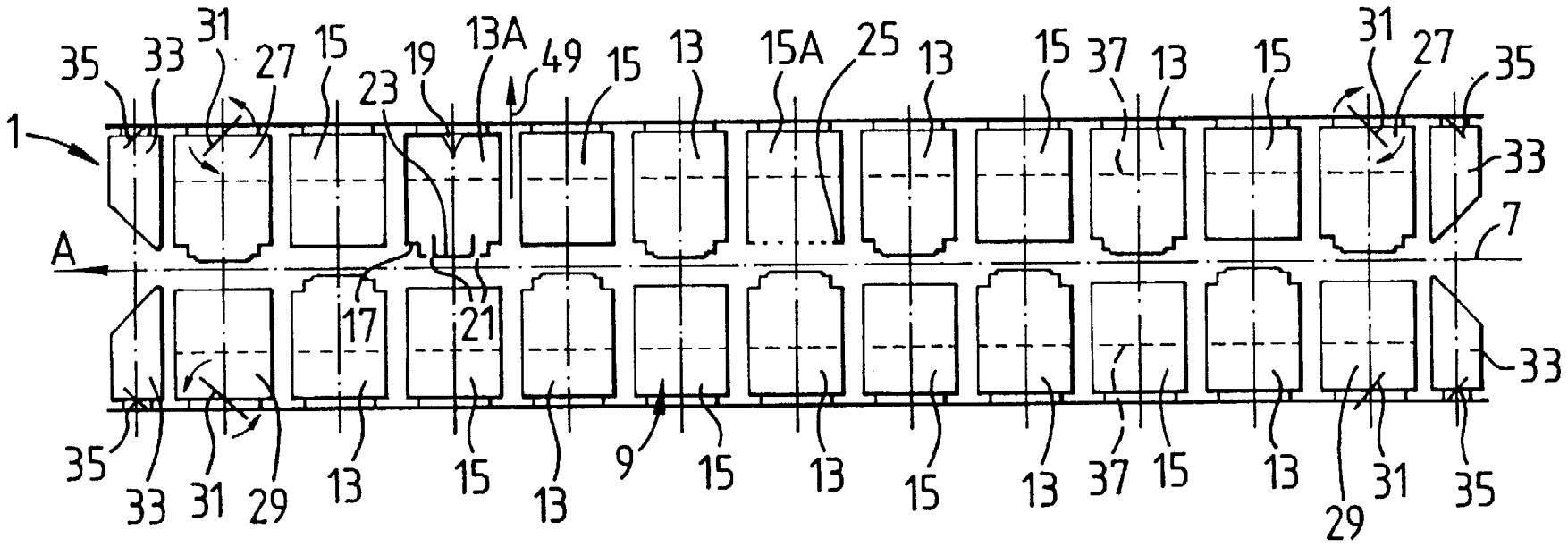
FIG. 1 is a cross-sectional view of the nozzle arrangement.
Figure 2:
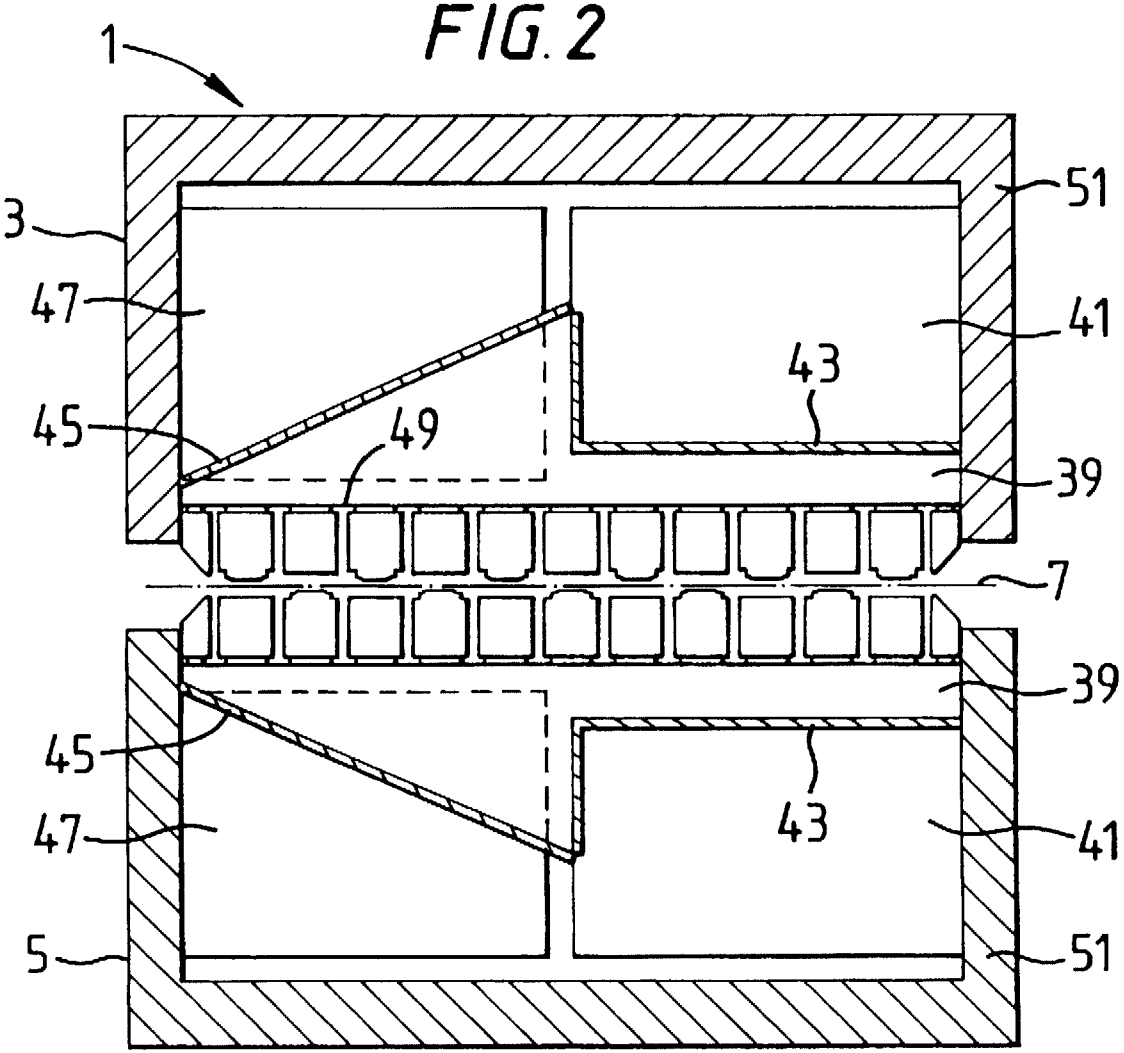
FIG. 2 is a cross-sectional side elevation of the dryer concept.

A web dryer 1 comprises two air bar assemblies 3.5 between which a web 7 travels. Each air bar assembly 3.5 comprises a plurality of parallel and spaced apart air bars 9. Each air bar 9 is elongate and arranged such that its longitudinal axis 11 is tranverse to the direction of travel A of the web 7. Each of the air bar assemblies 3.5 includes two sets of air bar. A first set 13 comprises coanda air bars and the second set 15 comprises jet impingement air bars.

Figure 5:
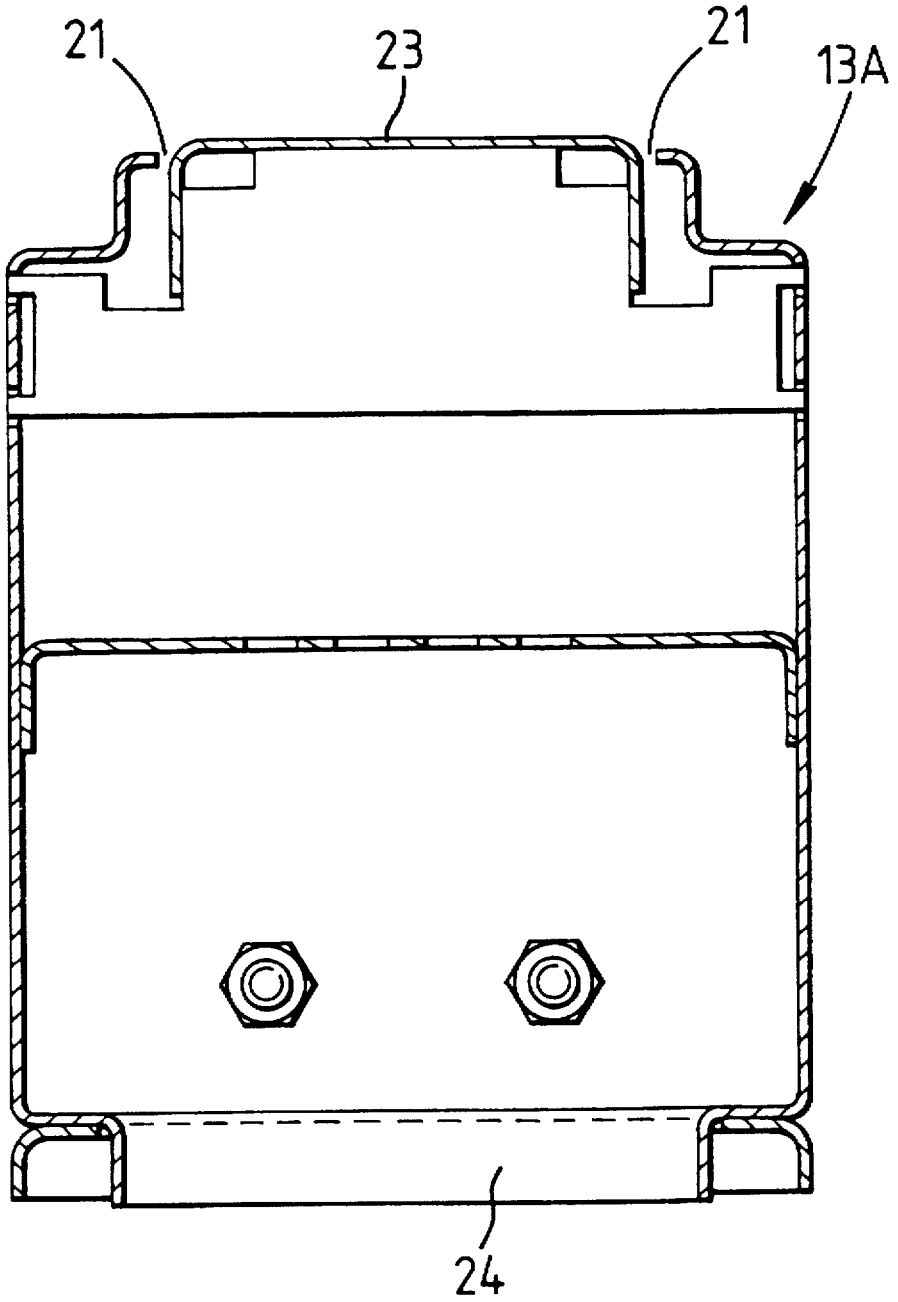
FIG. 5 is a schematic cross-section of a coanda air bar.

Only one of the coanda air bars 13A illustrates the web facing surface 17. FIG. 5 illustrates the air bar in more detail. The air bar is one sold under the trade mark SPOONER-FLOAT by Spooner Industries Limited. The dimensions of the bar are that the bar is 104 mm wide and 130 mm in height. The length of the air bar is chosen dependant on the web width to be handled. The air bar includes an inlet 19 of dimension 300 by 75 mm through which air is fed to the air bar. On its face 17 which in use faces the web 7 a pair of parallel linear nozzles 21 through which air passes to impinge on the web to support it. The nozzles are arranged such that they are aligned with the longitudinal axis of the air bar such that the nozzles are transverse to the direction of travel of the web. A central top plate 23 lies between the nozzles 21 where each edge of the top plate 23 forms one edge of a respective nozzle 21. The edges of the plate 23 are radiused such that air flowing from the nozzle is caused to flow over the radius surface 21 and therefore towards the centre of the bar. The bar includes a series of holes 24 at its base of dimension 300 by 75 mm which act as air inlets to the bar.

Figure 6:
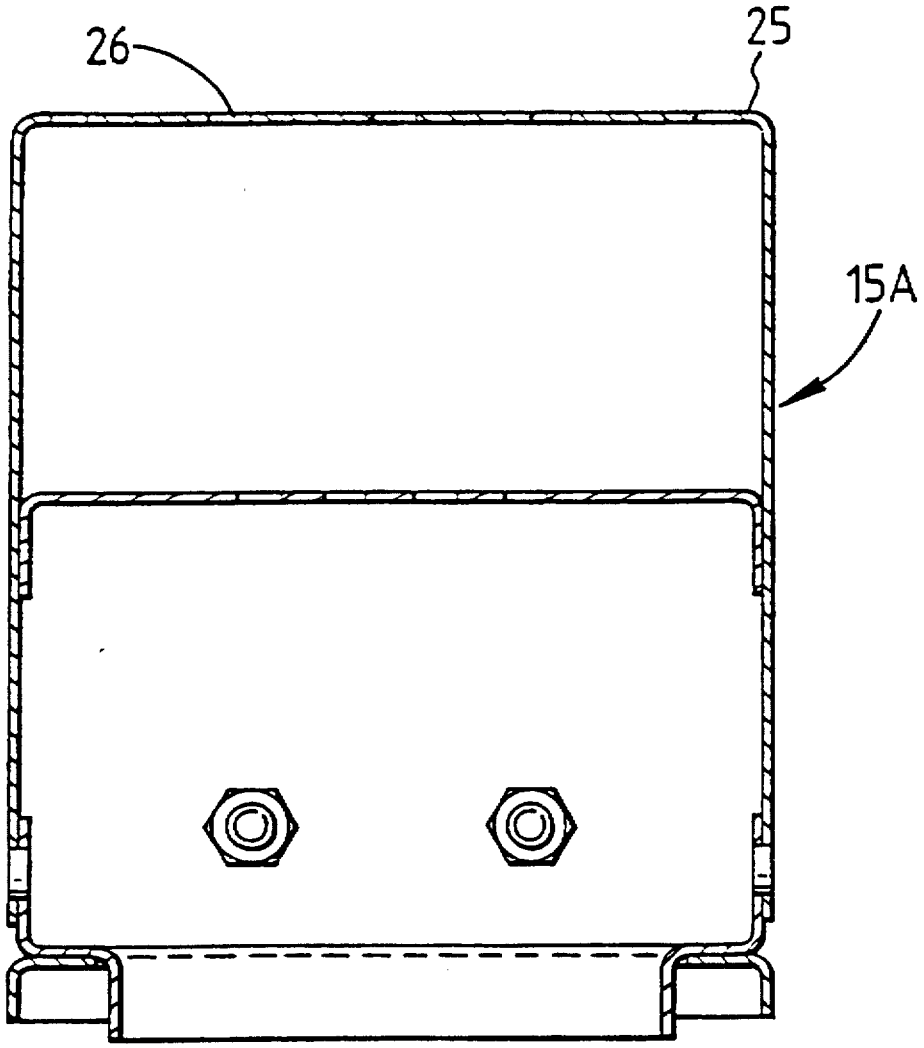
FIG. 6 is a schematic cross-section of a jet impingement air bar.

Each jet impingement bar 15, only one of which 15A is illustrated in FIG. 6, includes as its web facing surface 25 a perforate plate including a plurality of small orifices through which air may be blown to impinge upon the web 7 with no exhibition of coanda effect. The dimensions of the air bar are 104 mm in width and a height of 115 mm. The perforations 26 are of diameter 5 mm.

The air bars 13.15 are arranged in each air bar assembly 3.5 such that between each pair of coanda air bars 13 lies a jet impingement air bar 15 and between each pair of jet impingement air bar 15 lies a coanda air bar 13. Moreover each coanda air bar 13 faces a jet impingement air bar 15 and each jet impingement air bar 15 faces a coanda air bar 13. At the dryer entry and exit the coanda air bars 27 and jet impingement air bars 29 have positioned in their air feed system regulating dampers 31.

Also at the environment interface at entry and exit there are positioned above and below the web anti-overspill nozzles 33 in which are also fitted regulating dampers 35. The nozzles 33 are those sold under the trade mark ANTI-OVERSPILL by Spooner Industries Limited.

Regulating dampers 31 and 35 could be electrically or electronically controlled but here are manually independently adjustable.

Within each of the air bars 13,15,27 and 29 is a diffuser plate 37 which ensures an even air flow within the air bars.

The air bars are coupled to an air distribution chamber system 39 which is connected to the air feed duct system 41. At the interfaces between the air distribution chamber 39 and the air feed duct system 41 are positioned flow regulators 43. At the interface where the air flow enters return air duct 47 are positioned flow regulators 45. As can be seen air flows from the environment in the region of the web by outlets 49.

Alongside the air feed duct system 41 the air return duct system 47 is positioned. All of the foregoing is housed within an insulated shell 51.

Figure 3:
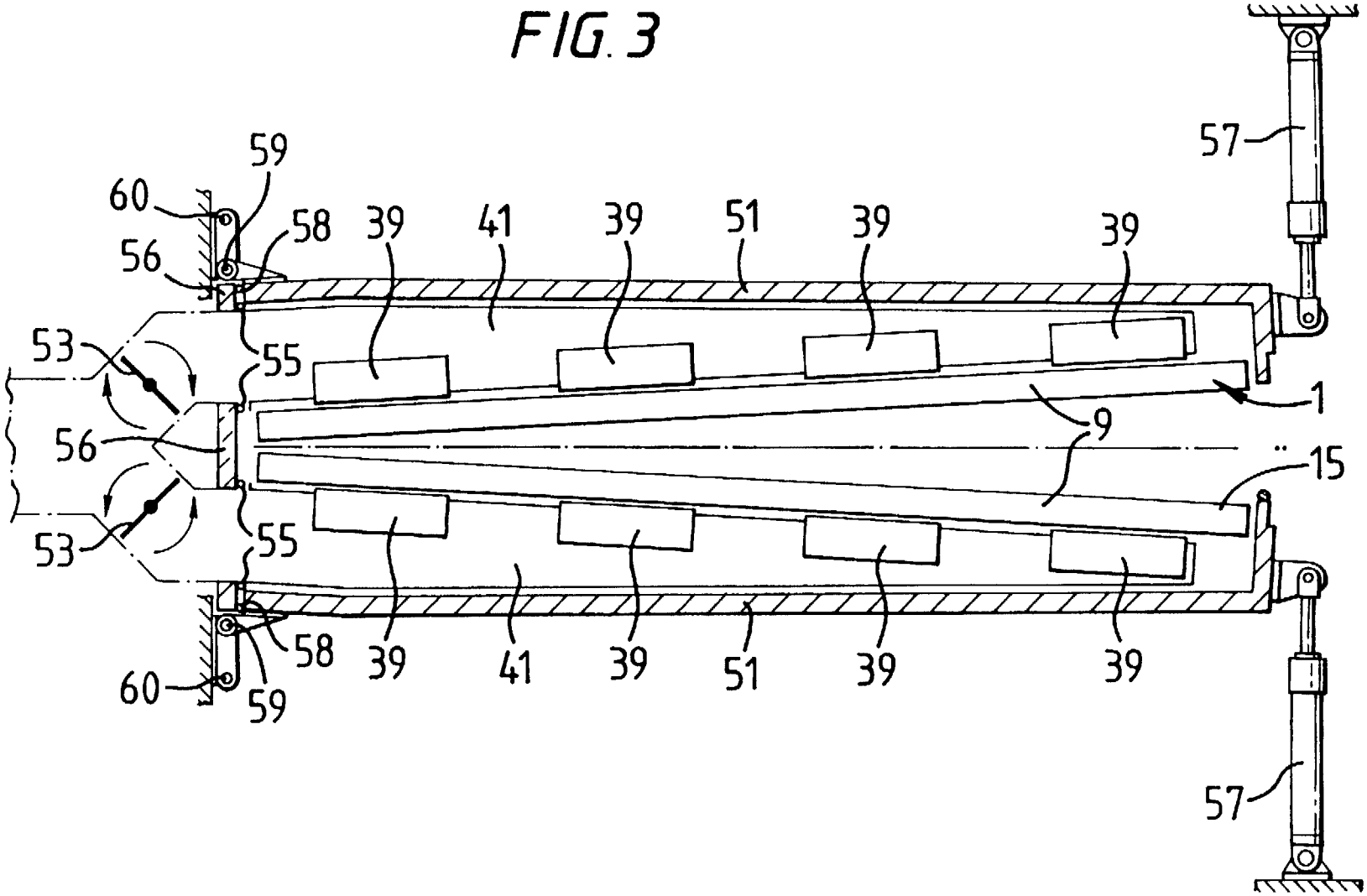
FIG. 3 is an end elevation of the dryer concept in the open position showing the proposed tapered chamber arrangement.

Regulating plates or dampers 53 are positioned at the entrance to the air feed duct system 41. The ducts conveying the gas to and from the dryer are terminated at the dryer interface. The stationary part of this interface is a substantial heavy duty membrane known as a backframe 56. The method of sealing between the backframe 56 and the air feed duct is a material to material seal, typically a metal flanged face seal 55. Alternatively a compressible gasket-type seal may be used. The flanges are adjusted such that the area for leakage between the backframe 56 and the air feed duct is minimal. This seal at this interface takes this form because the use of flexible ducts at this point would quickly result in material degradation due to high temperatures. It is possible however where space constraints permit, to use a high temperature flexible duct typically stainless steel A seal 58 between the backframe and the insulated shell 51 is a compressible seal and as such isolates the dryer body form the surrounding atmosphere. Pneumatic cylinders 57 (or similar actuators) move the top and bottom shells 51 of the dryer to pivot them about the pivot axes 59. The shell 51 is of tapered construction with its dimension perpendicular to web travel tapering gradually from the end at which it is pivotally mounted to its other end. This means that when the air bar assemblies are in their 'open' position shown in FIG. 3, the headroom required by the apparatus does not increase. This is sufficient for web threading and many maintenance operations. However if greater access is required than is afforded by movement of the shells 51 about pivot axes 59 then, provided that headroom is available, the original pivot axes 59 may be locked and the shells 51 moved about new pivot axes 60 to permit greater access. This facility would typically be utilised for extensive maintenance work. The apparatus relating to the external ancillary equipment is of standard design and is discussed in the Operation Procedure with reference to FIG. 4.

Operation of the Preferred Embodiment

Figure 4:
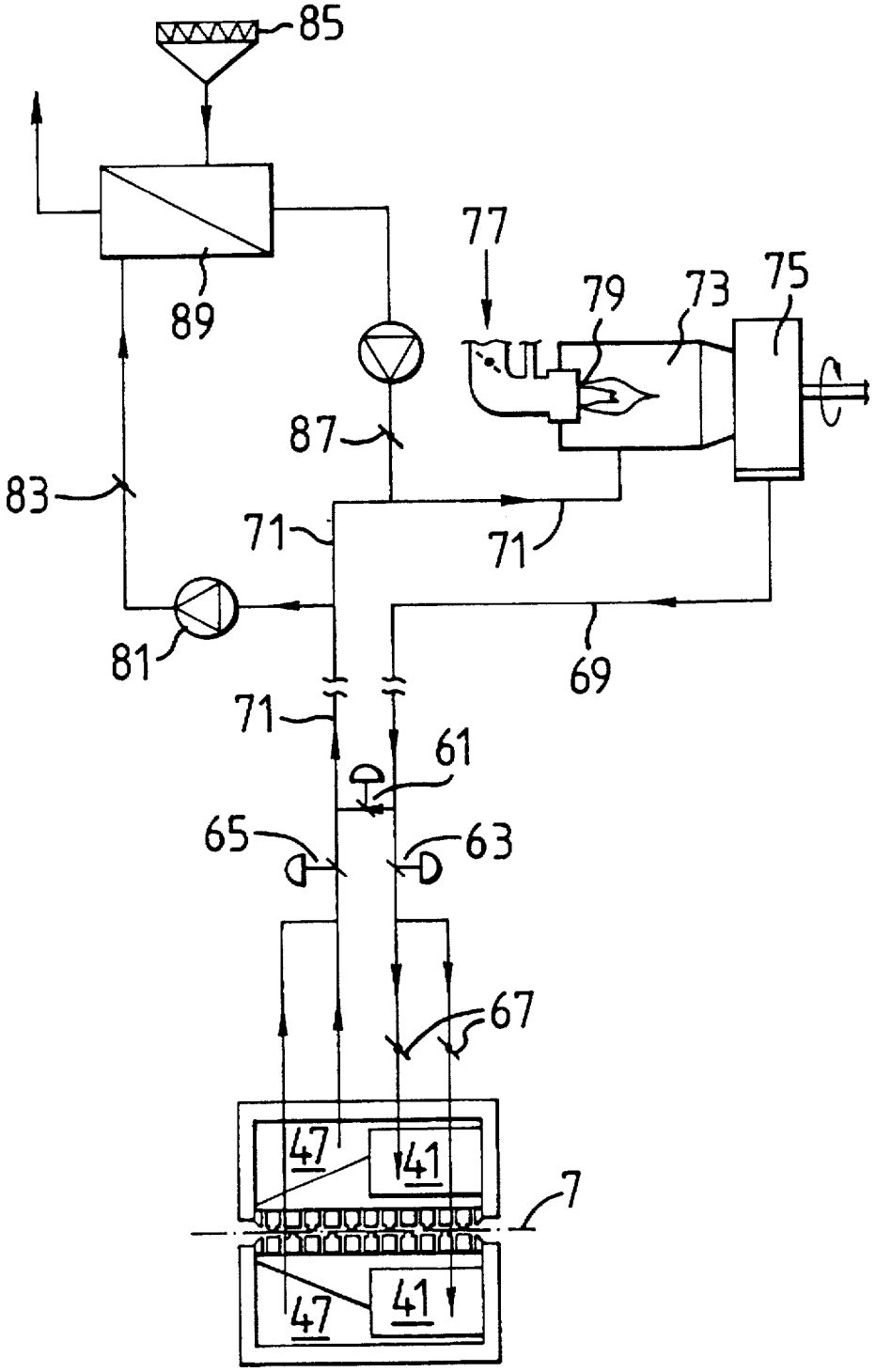
FIG. 4 is a diagram detailing the "air-circuit" layout.

With reference to FIG. 4 the operation of the air circuit layout is as follows:

When the dryer is in operation the by-pass damper 61 is closed, the air feed damper 63 and the air return damper 65 are open. The flow dampers 67 are typically adjusted to establish equal flow in the top and bottom compartments. Air is fed at a given temperature and pressure into the external air feed duct 69 and hence to the web 7.

Having impinged upon the web 7 the hot air causes the web to give up moisture. This moisture-laden airstream is drawn into the external air-return duct 71 and consequently back into the combustion chamber 73 where its temperature is raised again before being drawn into the fan 75 and recycled to the air-feed duct 69.

Combustion air and fuel 77 is supplied to the combustion burner 79 thus bringing about the temperature rise. If this alone were the air circuit then the humidity would build up to the point of saturation and, because of the introduction of the combustion air, the system would be out of balance and hence hot humid air would spill out uncontrollably into the surrounding environment.

To prevent this from happening a portion of the humid air flow in duct 71 is drawn off by an exhaust fan 81. The quantity drawn off is controlled by the exhaust damper 83 and is set to maintain the required humidity level within the dryer.

A quantity of air is introduced as "fresh" air, the cleanliness of which is guaranteed by the inlet filter 85. The amount of fresh air introduced to the system is controlled by the fresh air damper 87.

To "mass balance" the system the dampers are arranged as follows, the fresh air damper 87 is set such that the flow of fresh air and combustion air is balanced by the exhaust flow when the exhaust damper 83 is set to maintain the correct humidity conditions. To maximise the energy efficiency of the system the fresh air brought into the circuit can be raised in temperature by passing through an air to air heat exchange 89 and thereby transfer heat from the exhaust stream.

More specifically the air movement in the region of the nozzle arrangement is as follows:

The air reaches the nozzles types 13,15,27,29 & 33 in a substantially uniform manner with reference to cross machine and machine direction.

This is achieved by the following method. When considering the volumetric flow rate requirements in a cross-machine direction from back side to front side, it is clear to a person skilled in the art, that from back side to front side the volumetric flow rate required decreases as the nozzles demand for air is incrementally satisfied.

The air feed duct 41 is of a tapered cross-section to mirror this decrease in flow rate requirement, thus the velocity of the air in the duct 41 is kept to a constant, and because the air bars themselves cause a constant and uniform pressure drop on the system the air stream is discharged at a uniform velocity.

To further improve the substantially uniform nozzle velocity, internal flow regulators 43 are positioned at the interface between the air feed duct 41 and the air distribution chamber system 39 (known as fingers). These can take the form of vanes, damper blades diffuser plates, valves or a combination thereof. The purpose of the flow regulator 43 is to further equalise the flow of air from the air feed duct 41 into the finger (or plurality of fingers) 39. In this case the flow regulator is a diffuser plate. The uniformity of the nozzle velocity is further improved by the diffusers 37 located within the air bar bodies.

It is the coanda air bars 13 which have the most profound effect on the flotation characteristics displayed by the system. However if the coanda air bars were considered in isolation and the unit was operating on a web at low tension of circa 5 kg/m width, then at an operating velocity of circa 70 m/second the prevalent nozzle to material distances could be circa 40 mm and as such the heat transfer capability and the web stability would be impaired.

But when considering the system in full including the jet impingement air bars 15, the air flow is normally delivered substantially uniformly to both the coanda air bars 13 and the jet impingement air bars 15, the action of the air entering the air bars is to establish a high magnitude cushion pressure region.

The air exiting the jet impingement air bars 15 impinges on the web 7 with the effect that they contribute greatly to the heat transfer coefficient on the opposite side to that on which the coanda cushion is established. When the jet streams of air from the jet impingement air bars 15 come into contact with the web 7 they are effectively stopped and as such their velocity pressure is transferred into static pressure. The effect of these localised static pressure regions is to establish an average static pressure region above the face of the jet impingement air bars 15.

This secondary static pressure region is applied to the web 7 in opposition to the coanda cushion, which has the action of suppressing the amplitude of the sine wave generated by the coanda air bars, such that when operating the unit at 70 m/s air velocity on a web at 5 kg/m width tension, the nozzle to material distance would be circa 5–10 mm, thus maximising the heat transfer capability of the nozzle system and ensuring web stability. The standard air bars 13,15 are surrounded by other air bars and hence the forces acting upon the web are in equilibrium. However the air bars at entry and exit 27,29 have the nozzle system on one side and the external environment on the other and hence the web 7 registers a force imbalance.

Dampers 31 are adjusted such that the magnitude of the cushion generated above the coanda air bar 27 is sufficient to maintain the web 7 in the equilibrium position. The exhaust damper 83 can be adjusted such that the ambient pressure level within the dryer body is very slightly negative. However because air bars 27,29 are sited very close to the entry and exit there is still a tendency for these nozzles to cause overspill of the dryer atmosphere to the surrounding environment. To prevent this from happening dampers 35 in the anti-overspill nozzles 33 are adjusted until the internal atmosphere is prevented from escaping from the dryer enclosure.

Once the high temperature high velocity air stream has impinged upon the web 7 and caused evaporation there is a requirement for this "spent" air to be returned to the recirculating circuit. This must be achieved in a ially uniform manner in the cross-machine direction because high levels of air movement across the sheet surface could impair the product quality and in the extremes can cause the web to move or track sideways.

Substantially uniform return flow is brought about regulating the air flow at the interface into the air return duct 47 with flow regulator 45. These can be dampers,vanes,diffuser plates, valves or a combination thereof. Here they are diffuser plates. In this manner the returning flow is made to be substantially uniform across the width of the web. The dimensions of this dryer are 2 meters long by 4.8 m wide by 2 m (i.e. 1 meter at either side of the web 7.

I claim:

1. A web dryer (1) comprising two air bar assemblies (3,5) between which a web (7) travels, each air bar assembly (3,5) comprising a plurality of parallel and spaced apart air bars (9), each air bar (9) being elongate and arranged such that its longitudinal axis is transverse to the longitudinal axis of the dryer (1), each of the air bar assemblies (3,5) including at least two sets of air bar, a first set (13) comprising coanda air bars, each having at least two air nozzles, and the second set (15) comprising jet impingement air bars and in which the air bar assemblies (3,5) are arranged such that in use each coanda air bar (13) from one assembly faces a jet impingement air bar (15) from the other assembly characterized in that air flows flowing from each of the air nozzles of a coanda bar converge towards the center of said bar.

2. A web dryer (1) according to claim 1, which the air bars (13, 15) are arranged in each air bar assembly (3,5) such that between each pair of coanda air bars (13) lies a jet impingement air bar (15), and between each pair of jet impingement air bars (15) lies a coanda air bar (13).

3. A web dryer (1) according to claim 1, in which each air bar assembly (3,5) includes at least one air feed duct (41), for feeding gas to the air bars (9), each air bar (9) being fed from an air feed duct (41) via a plurality of feed inlets (39) spaced along the air bar, the air feed duct (41) extending substantially along the length of the air bar (9) and coupled to a source (19) of pressurized gas in the region of one end of the air bar (9) the air feed duct (41) tapering along the length of the air bar (9), such that the cross-section of the duct (41) is greater at the end of the duct at the region of the gas source, and less at the end of the duct remote from the gas source.

4. A web dryer (1) according to claim 3, in which a first gas flow regulator (43) is mounted between the air feed duct (41) and the air bar (9), and a second gas flow regulator (45) is mounted in the inlet to a gas return duct (47) via which air is fed out of the web region.

5. A web dryer (1) according to claim 1, in which the dryer is capable of fitting within a confined space of the order of 2 meters in web direction and 2 meters perpendicular to the web.

6. A web dryer (1) according to claim 1, in which at least one of the air bar assemblies (3,5) is pivotably mounted with respect to a pivot axis (59) substantially parallel to the web (7), at or adjacent one end of the air bars (9), the air bar assembly (3, 5) being mounted within a shell (51) of tapered construction with its dimension in a direction perpendicular to the plane of the web (7) tapering from a maximum in the region of the pivot axis (59) to a minimum in the region of the end of the assembly (3,5) remote from the pivot axis (59).

7. A web dryer (1) according to claim 1, in which at least one of the air bars (27,29) positioned at each of the entry and exit ends of the assemblies (3,5) includes a flow regulator (31) to control the flow of gas into the air bar (27,29).

8. A web dryer (1) according to claim 1, in which at least one air bar assembly (3,5) includes at one or both ends of the bank of air bars (13,15) a single slot nozzle (33) acting as a dynamic seal curtain to isolate the region of the air bars and the web (7) from the surrounding environment.

9. A paper machine including a web dryer arranged according to claim 1.

* * * * *